US006609555B2

(12) United States Patent
Spengler, III et al.

(10) Patent No.: US 6,609,555 B2
(45) Date of Patent: Aug. 26, 2003

(54) CASTING ROLLOVER APPARATUS

(75) Inventors: Robert H. Spengler, III, Bloomfield Hills, MI (US); Michael H. Kuvasta, Brighton, MI (US)

(73) Assignee: Adams Automation, Southfield, MI (US)

( * ) Notice: Subject to any disclaimer, the term of this patent is extended or adjusted under 35 U.S.C. 154(b) by 84 days.

(21) Appl. No.: 10/001,034

(22) Filed: Nov. 2, 2001

(65) Prior Publication Data

US 2002/0079082 A1 Jun. 27, 2002

Related U.S. Application Data

(60) Provisional application No. 60/245,759, filed on Nov. 3, 2000.

(51) Int. Cl.[7] ..... B22C 17/08

(52) U.S. Cl. ..... 164/409; 164/306; 164/337; 164/183; 164/224

(58) Field of Search ..... 164/409, 306, 164/119, 255, 63, 337, 183, 224

(56) References Cited

U.S. PATENT DOCUMENTS 4,733,714 A 3/1988 Smith ..... 164/130
4,744,260 A * 5/1988 Bond ..... 74/98
5,163,500 A * 11/1992 Seaton et al. ..... 164/130
5,491,830 A * 2/1996 Ferri ..... 395/829
5,492,165 A * 2/1996 Erana ..... 164/255

* cited by examiner

*Primary Examiner*—Tom Dunn
*Assistant Examiner*—I.-H. Lin
(74) *Attorney, Agent, or Firm*—Young & Basile, P.C.

(57) ABSTRACT

A casting rollover apparatus includes a cage supporting a casting mold and a slide coupled to the cage for advancing the mold into and out of engagement with a molten metal discharge nozzle. A spindle is carried on the slide and coupled to the cage for rotating the cage. A clamp cylinder is carried on the cage for clamping the mold in the closed position. A single transducer is mounted on one of a pair of pressurized fluid drive cylinders on the slide to detect the position of the slide. Electrical plug connectors are coupled to the transducer and the cylinder control elements. Thrust bearings are mounted on the spindle and apply a pre-load to the spindle. A digital proportional valve is coupled to a drive cylinder for controlling the deceleration of the spindle. A position detector switch is mounted in the path of angular rotation of the spindle to initiate spindle deceleration. The clamp cylinder carries a tubular member coupled to the piston and movable with respect to the clamp cylinder housing. An end of the tubular member is formed as a scrape surface to remove debris from the sidewall of the clamp cylinder.

9 Claims, 7 Drawing Sheets

CASTING ROLLOVER APPARATUS

CROSS REFERENCED TO CO-PENDING APPLICATION

This application claims the benefit of the filing date of provisional patent application Ser. No. 60/245,759 filed Nov. 3, 2000 in the name of Robert H. Spangler, III and Michael H. Kaubasta and entitled "Casting Rollover Apparatus," the entire contents of which are incorporated herein by reference.

BACKGROUND

In casting work pieces, such as engine blocks, from various metals, it is well established that with certain metals, such as aluminum, the molten metal contains impurities which, if cast into the workpiece, could result in imperfections or weak areas in the workpiece. To address this problem, the assignee of the present invention previously devised a multiple-station rollover device, shown in FIG. 1, which receives the mold cores, moves the mold cores, after the cores are clamped in a non-movable position, into engagement with a molten metal discharge nozzle for the discharge of molten metal into the mold cores, and, finally, moves the filled core to an unload station. While the molten metal in the mold cores is still molten, the prior apparatus uniquely turned the mold cores over approximately 180°. This caused any impurities in the molten metal to rise to the rotated top of the mold cores. Specially designed, elongated runners or cavities in what was originally the bottom of the mold cores, received the molten metal and the impurities as the impurities rise to the top of the molten metal in the runners thereby essentially removing the impurities from the molten metal actually forming the workpiece. After solidification, the runners are separated from the cast work piece thereby removing the impurities from the workpiece.

The Assignee's prior casting rollover apparatus makes use of multiple stations of a base mounted on the rotary table, a slide mounted in the base for movement relative to the base to bring the mold cores into and out of engagement with the molten metal discharge nozzle, and a spindle carried on the slide which is capable of rotating the entire mold core and a surrounding support cage and clamps.

In operation, the rotary table advances one of the cages carrying a closed mold core to the molten metal pump station. The slide is advanced to move the spindle and the workpiece clamp cage from a retracted position to an extended position wherein the mold core is disposed in fluid communication with the molten metal discharge nozzle. The molten metal, typically aluminum, is then pumped through the nozzle into the mold core.

While the molten metal is still molten in the mold core, the spindle rotates the cage and the mold cores 180° causing any impurities which may be present in the molten metal to rise to the top of the inverted mold core and solidify in the runners which are subsequently separated from the main workpiece. The slide is then reversed to retract the spindle and the cage away from the discharge nozzle. The rotary table then brings the filled mold core to an unload station where the mold core is removed from the cage.

While the Assignee's prior casting rollover apparatus has proven effective over many years of operation, it is believed that certain improvements could be made to the casting rollover apparatus to improve its reliability, to reduce manufacturing costs, and to simplify the replacement or changeover of certain parts of the apparatus.

SUMMARY

The present invention is an improved casting rollover apparatus which provides improved performance and reliability over previously devised casting rollover apparatus.

In one aspect, the casting rollover apparatus of the present invention includes a cage supporting an openable and closable casting mold, an extensible and retractable slide coupled to the cage for moving the cage and the casting mold into and out of engagement with a molten metal discharge nozzle, a spindle carried on the slide and coupled to the cage for rotating the cage, and a clamp cylinder carried on the cage for clamping the mold in the closed position.

In one aspect, the slide includes first and second pressurized fluid operable cylinders coupled to extend and retract the slide, and a single transducer mounted on one of the first and second cylinders for detecting the position of the slide.

Preferably, electrical plug connectors are used to electrically interconnect the transducer with the cylinder control elements, such as a control for and a solenoid.

In another aspect, the spindle includes a spindle housing surrounding the spindle, an end cap mounted on one end of the spindle housing, and thrust bearings mounted between the spindle and the end cap. The thrust bearings provide a pre-load force on the spindle.

In another aspect, the spindle further includes means, coupled to the spindle, for rotating the spindle, at least one pressurized fluid cylinder coupled to the rotating means to drive the rotating means, and a digital, proportional valve coupled to the cylinder for receiving a variable electric current from a controller to smoothly decelerate rotation of the shaft. Further, end-of-travel detectors cooperate with the spindle to generate output signals indicating the end of rotational travel of the spindle in one direction. At least one deceleration-initiating sensor is spaced angularly from one of the end-of-travel switches, the declaration initiating sensor generating an output to the controller to initiate decleration of the spindle.

In yet another aspect, the clamp cylinder includes a cylinder housing having a sidewall, a piston movably disposed in the cylinder housing and movable between first and second positions in response to the input and exhaust of pressurized fluid into the cylinder housing on opposite sides of the piston, and input and exhaust ports carried on an end of the cylinder housing for providing the intake and exhaust of pressurized fluid into the cylinder housing.

In this aspect, a tubular member has a sidewall, guide rods coupled between the piston and an end plate on the tubular member, and a spacer coupled to the tubular member and having through bores slideably receiving the guide members therethrough.

Further, the tubular member encloses one end of the cylinder housing. The tubular member is coupled to and movable with the piston. An end of the tubular member is concentrically disposed over the sidewall of the cylinder and defines a scraping surface with respect to the sidewall of the cylinder housing.

The casting rollover apparatus of the present invention provides many advantages over previously devised casting rollover apparatus of the same type. First, only a single transducer is employed to detect the position of the slide. This reduces a part count. The use of the single transducer, when coupled with removable electric plug connectors, simplifies the replacement and removal of the transducer by eliminating the need to remove the prior solder connections between the transducer and the controller or solenoid conductors.

The use of thrust bearings in the spindle simplifies the assembly of the spindle as well as enabling a pre-load force to be applied to the spindle.

The use of a digital proportional valve to control the electric current to the drive cylinder on the spindle enables the spindle to be smoothly decelerated to a "stop" position. Detector switches angularly spaced from the end of travel position detector switches on the spindle uniquely initiate the start of spindle decleration.

The unique clamp cylinder of the present invention has end ports which enable the port connections to be spaced a further distance from the mold to minimize any accumulation of mold flash or debris on the port connections. Further, the tubular member mounted on one end of the cylinder housing provides a scraping action over the sidewall of the housing to remove any debris or metal flash which may accumulate on the cylinder and which previously would interfere with the smooth operation of the clamp cylinder.

BRIEF DESCRIPTION OF THE DRAWINGS

The various features, advantages and other uses of the present invention will become more apparent by referring to the following detailed description and drawing in which.

DETAILED DESCRIPTION

The following description of the complete casting rollover apparatus will necessarily include components which appear in the above-described prior casting rollover apparatus. The improvements or new components will be described in detail where appropriate.

Figure 2:
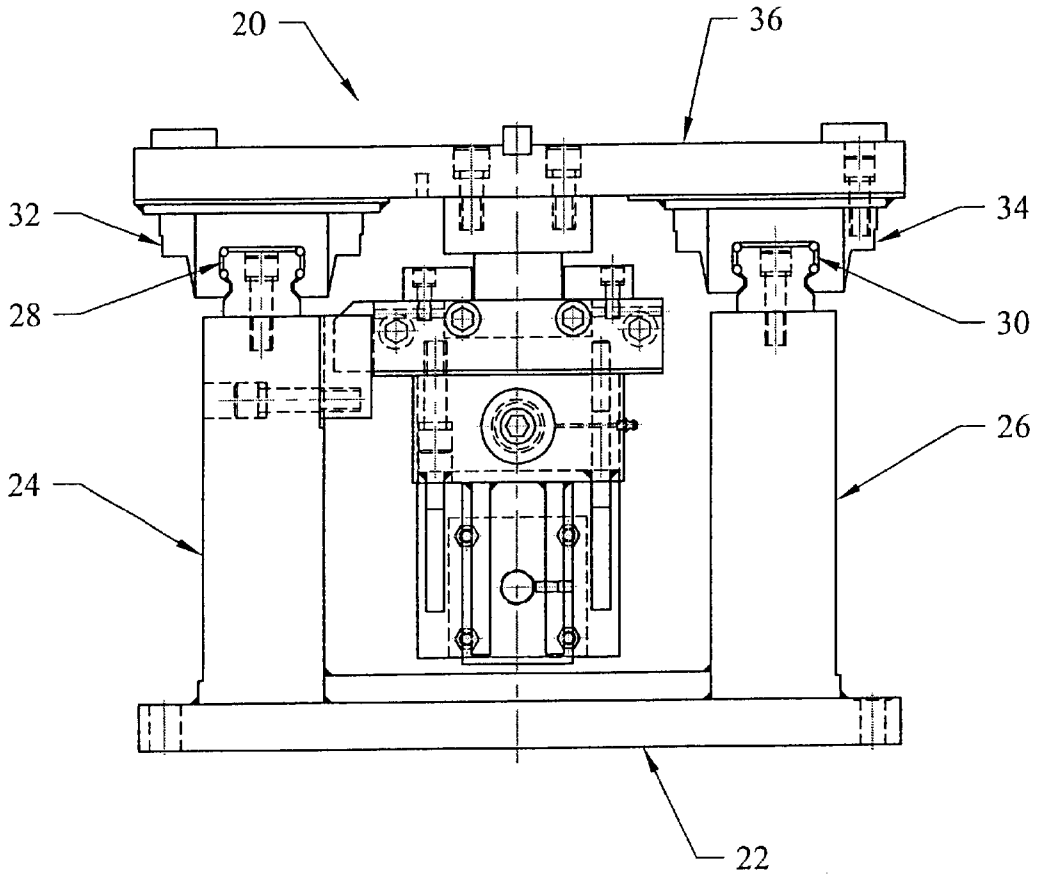
FIG. 2 is an end view of a slide for a casting rollover apparatus according to the present invention.
Figure 3:
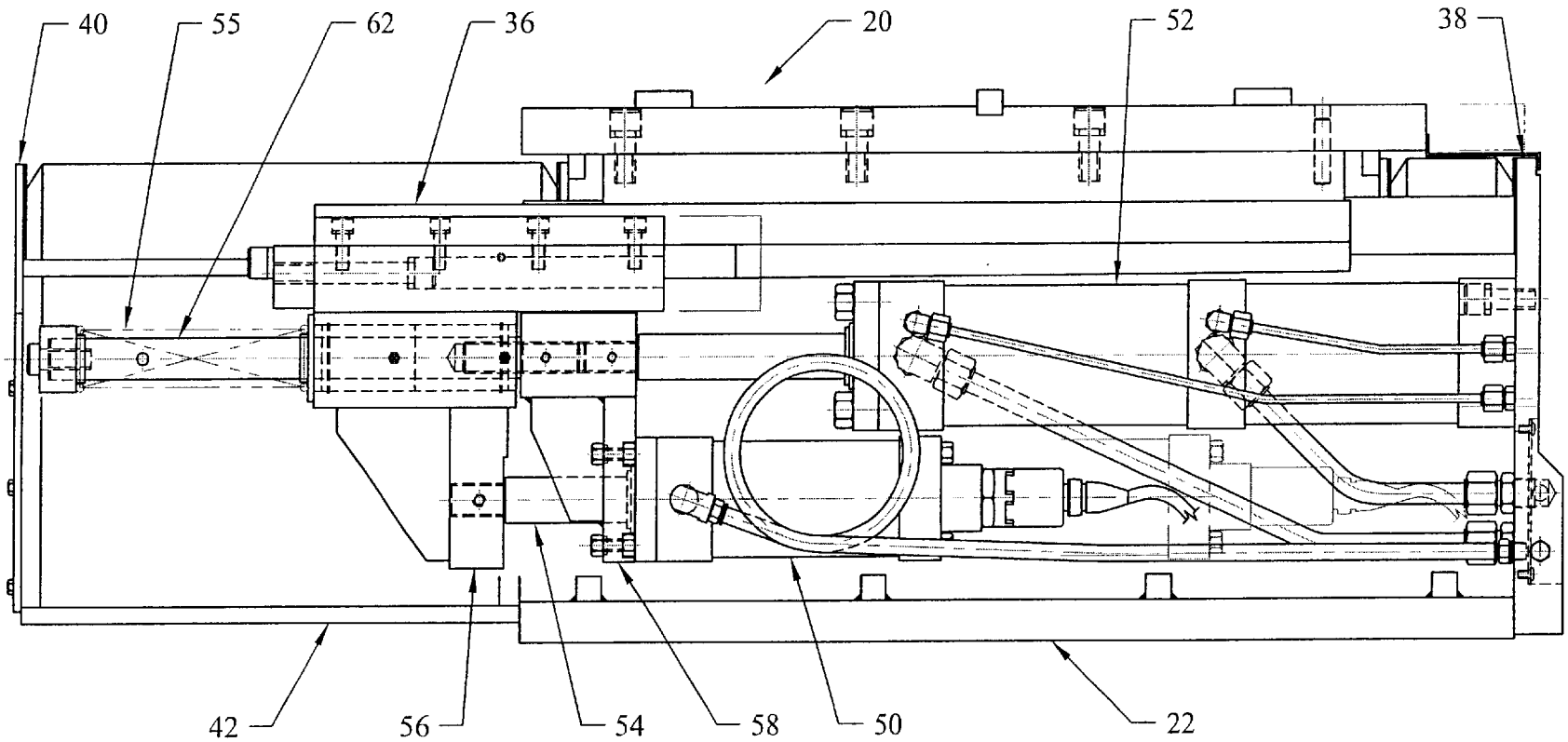
FIG. 3 is a side elevational view of the slide shown in FIG. 2.

Referring now to FIGS. 2 and 3, there is depicted a detailed view of the slide 20 of the casting rollover apparatus 10. The slide 20 includes a base formed of a weldment containing a base plate 22 and two upstanding side plates 24 and 26. Bearing blocks 28 and 30 are mounted on the upper ends of the side plates 24 and 26, respectively, for sliding engagement with movable bearings 32 and 34. The bearing blocks 28 and 30 and the movable bearings 32 and 34 are part of a commercially available linear bearing assembly. A saddle or platen 36 is fixedly mounted to the movable bearings 32 and 34 for longitudinal extension as described hereafter.

As shown in FIG. 3, which depicts a side view of the slide 20 with the left side plate 24 removed, there is depicted the two end plates 38 and 40 which are fixed to opposite ends of the side plates 24 and 26 as well as to a base extension 42.

The slide 20 is provided with the capability of a predetermined amount of linear travel, such as four inches, by example only. The slide 20 is also devised to create a force on the molten metal discharge nozzle, not shown, to form a seal between each mold core mounted in the cage, as described hereafter, and the molten metal machine discharge nozzle.

A pneumatic or air cylinder 50 and a hydraulic fluid cylinder 52 are mounted on the end plate 38, with fluid connections extending through the end plate 38 to the various ports on the cylinders 50 and 52. The cylinders 50 and 52 work in conjunction with a die spring 55.

Specifically, a cylinder rod 54 extensibly projects from one end of the pneumatic cylinder 50. One end of the rod 54 is threadingly secured to a bracket 56. The rod 54 also extensibly projects through a second bracket 58 which is fixed to one end of the air cylinder 50.

The other end of the second bracket 58 receives a threaded end of a cylinder rod 60 projecting from the hydraulic cylinder 52. The second bracket 58 also receives a threaded end of an interconnecting rod 62 which slidably extends through the upper portion of the first bracket 56. The first bracket 56 is fixedly secured by bolts to the saddle or platen 36. The die spring 55 is mounted over one end of the interconnecting bracket 62.

Energization of the B return port of the pneumatic cylinder 50 pulls the bracket 56 solidly into contact with the bracket 58. This enables elimination of the use of the spring 55 for force control and turns the slide 20 into direct hydraulic force control. Energization of the B port of the hydraulic cylinder 52 will result in the advance feed of the platen 36 to the right which, in a machine orientation, is toward the molten metal discharge machine nozzle. At a predetermined set point (set point one) defined by a predetermined distance between the inlet of the mold cores and the molten metal discharge nozzle, which is measured by a sensor, such as a proximity switch mounted on the side plate 24, the pneumatic cylinder 50 return port exhausts to atmosphere.

This allows the brackets 56 and 58 to move independent of each other. With the B port of the hydraulic cylinder 52 still energized, the mold core comes in contact with the molten aluminum discharge nozzle. Once the mold core contacts the molten aluminum discharge nozzle, the brackets 56 and 58 start to separate which begins the collapse of die spring 55. The collapse of die spring 55 generates a spring force pushing the platen 36 to the right in FIG. 3, or toward the molten aluminum discharge nozzle. At the same time the brackets 56 and 58 are separating, the rod 54 of the pneumatic cylinder 50 starts to extend, which translates into movement of the linear transducer mounted inside pneumatic cylinder 50. The pneumatic cylinder 50 extends to a predetermined set point "mold secure", set point two. Once set point two is made, the proper amount of sealing force between the mold core and the molten aluminum discharge nozzle has been achieved.

According to the present invention, only a single position sensor or linear transducer, which is disposed through the center of the pneumatic cylinder 50, is used to detect when the platen 36 reaching the mold secure or set point two position. Previously, separate sensors or linear transducers were employed on both cylinders 50 and 52. The present invention eliminates the linear transducer on the cylinder 52.

Using only one transducer also simplifies the replacement of the transducer by using a insertable plug connector for the wiring connections between the transducer, the cylinder actuation solenoids and the external controller. Previously, protective dust covers were employed on both cylinders 50 and 52 to protect the position sensor or linear transducers mounted therein as well as the electrical connections to the linear transducers. The wire terminals were soldered to a connector mounted on the dust cover which required difficult assembly and disassembly of the solder connections during replacement of the transducer.

While the dust covers provided the desired protection from the ambient environment, replacement of the transducers due to damage, wear, or inoperability was time consuming due to the need to first remove the dust cover and then disconnect each soldered electrical connection. The use of the plug-in connector enables all the connections to be made or disengaged at one time in a quick and easy plug-in action.

Figure 4:
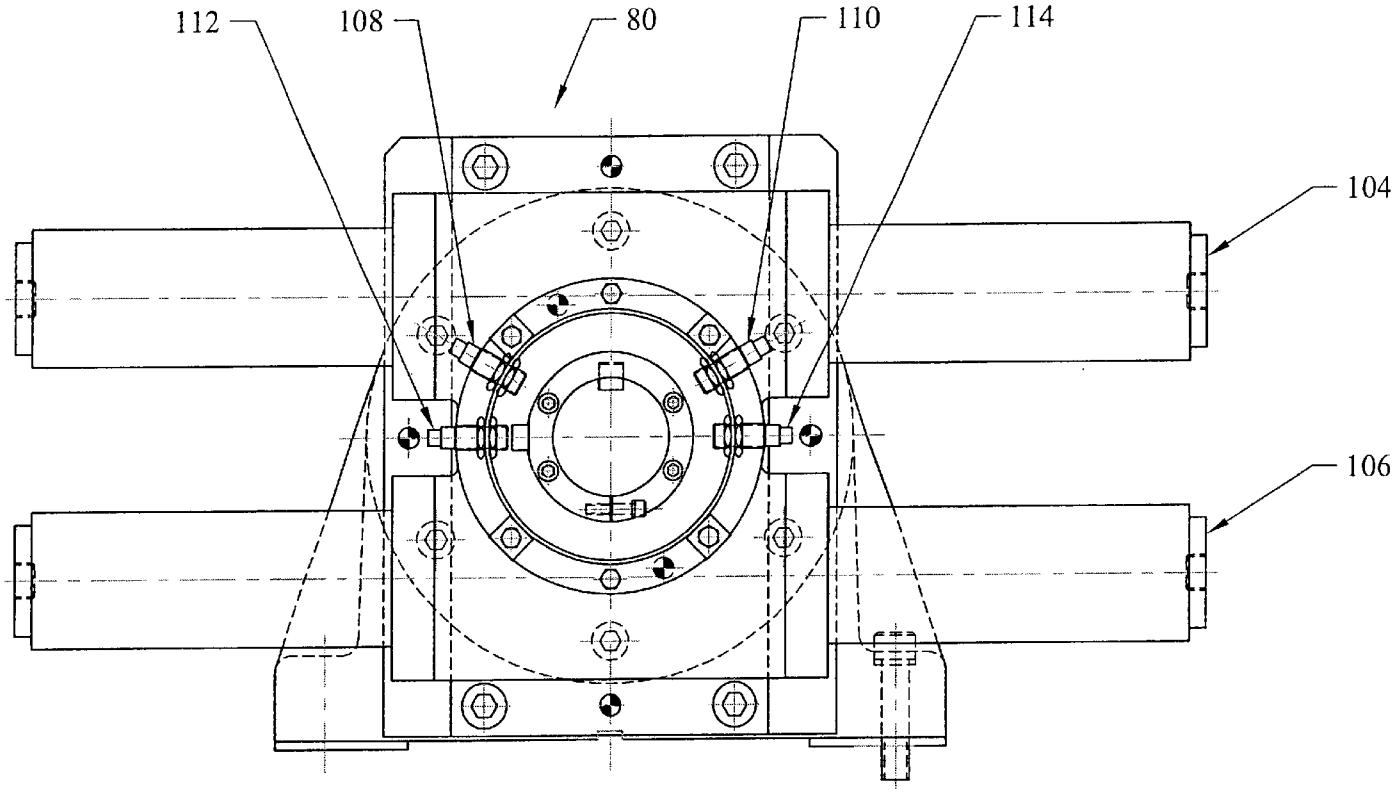
FIG. 4 is an end elevational view of a spindle for a casting rollover apparatus according to the present invention.
Figure 5:
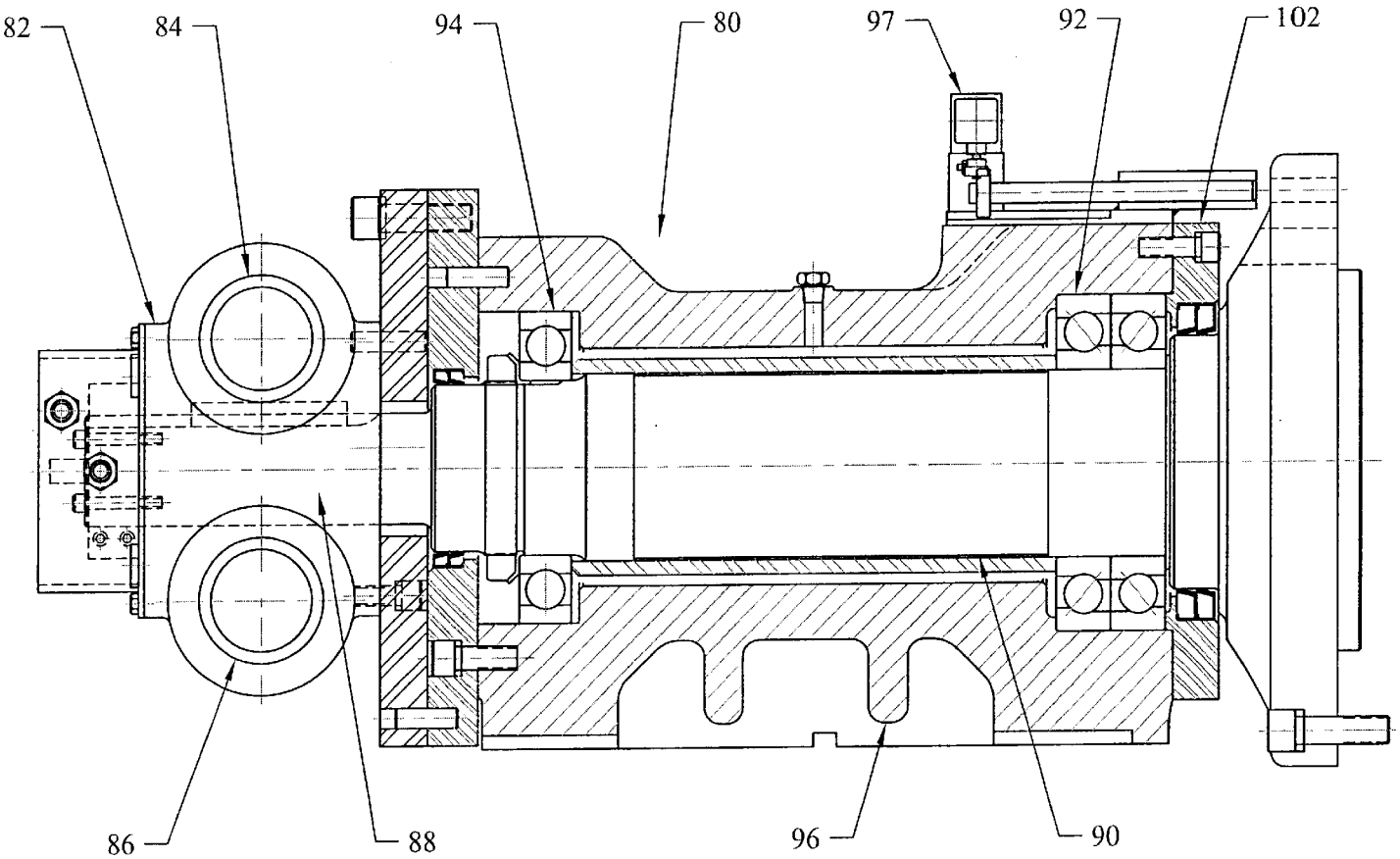
FIG. 5 is a longitudinal, cross-sectional view of the spindle shown in FIG. 4.

Referring now to FIGS. 4 and 5, there is depicted the spindle 80 according to the present invention. The spindle utilizes a rotary actuator 82, such as a Parker (M) series rotary actuator Model No. 150M-1803C-XXIV-B63. This rotary actuator 82 utilizes two spaced, parallel, rotatable racks 84 and 86 having a rotatable pinion 88 therebetween. Simultaneous activation of the racks 84 and 86 causes opposite linear movement of the racks 84 and 86 and a rotation of the pinion 88. As shown in FIG. 5, the pinion 88 is connected to one end of an elongated shaft 90 which is rotatably mounted by means of a first bearing assembly 92 at one end, and a second bearing assembly 94 at an opposite end of a housing 96 which is fixedly mounted on the platen 36.

The second bearing assembly 94 is preferably a conventional ball bearing assembly which supports one end of the shaft 90. The first bearing assembly 92 is improved over Assignee's prior casting rollover apparatus in that it includes a unique arrangement of thrust bearings which are mountable in the housing 96 in a simplified assembly process.

In the prior spindle, it was necessary to first bolt the spindle together, drop the suit plate over the spindle, force the spindle through the bearings, lower the housing over the spindle and then bolt the assembly together. In the present invention, due to the orientation of the thrust bearings in the first bearing stack 92, the bearings 92 can move in and out of the spindle housing 96 after removal of an end cap 102. This significantly reduces the time required to assemble the spindle 80 and may actually reduce the assembly time up to half of that required for the spindle in Assignee's prior casting rollover machine.

It should also be noted that lowering the housing 96 over the spindle shaft 90 squeezes the outer races of the bearing 92 against the inner races of the bearing 92 thereby trapping the inner races in a non-separable position with respect to the housing 94 and the spindle shaft 90. This arrangement of the bearings 92 also provides a pre-load on the spindle shaft 90 which prevents longitudinal movement of the spindle shaft 90.

The spindle 80 is also provided with a unique run switch 97 which, when made, provides an indication of "okay to run." When the switch 97 is not made, it is not okay to run the casting apparatus or to rotate the spindle.

Finally, the spindle 80 utilizes pressurized, fluid-operated cylinders 104 and 106 to drive the racks 84 and 86 to rotate the spindle shaft 90 via the pinion 88. Previously, the rack drive cylinders were provided with cushions which operated to bleed off cylinder pressure at the end of cylinder rod travel. This was used to decelerate the rotation of the spindle shaft 90 at the end of either bi-directional rotation.

The present spindle employs a digital proportional valve and two new switches, such as proximity switches 108 and 110, which are mounted on the end of the spindle 80. The switches 108 and 110 are located angularly ahead of the end of travel switches 112 and 114 and are used to generate an external control signal to the spindle controller, typically a programmable logic controller (PLC), which, in turn, generates external trigger signals to vary the current to the proportional valves to thereby smoothly decelerate the rotation of the spindle shaft 90 until it reaches its end of rotation position.

Figure 6:
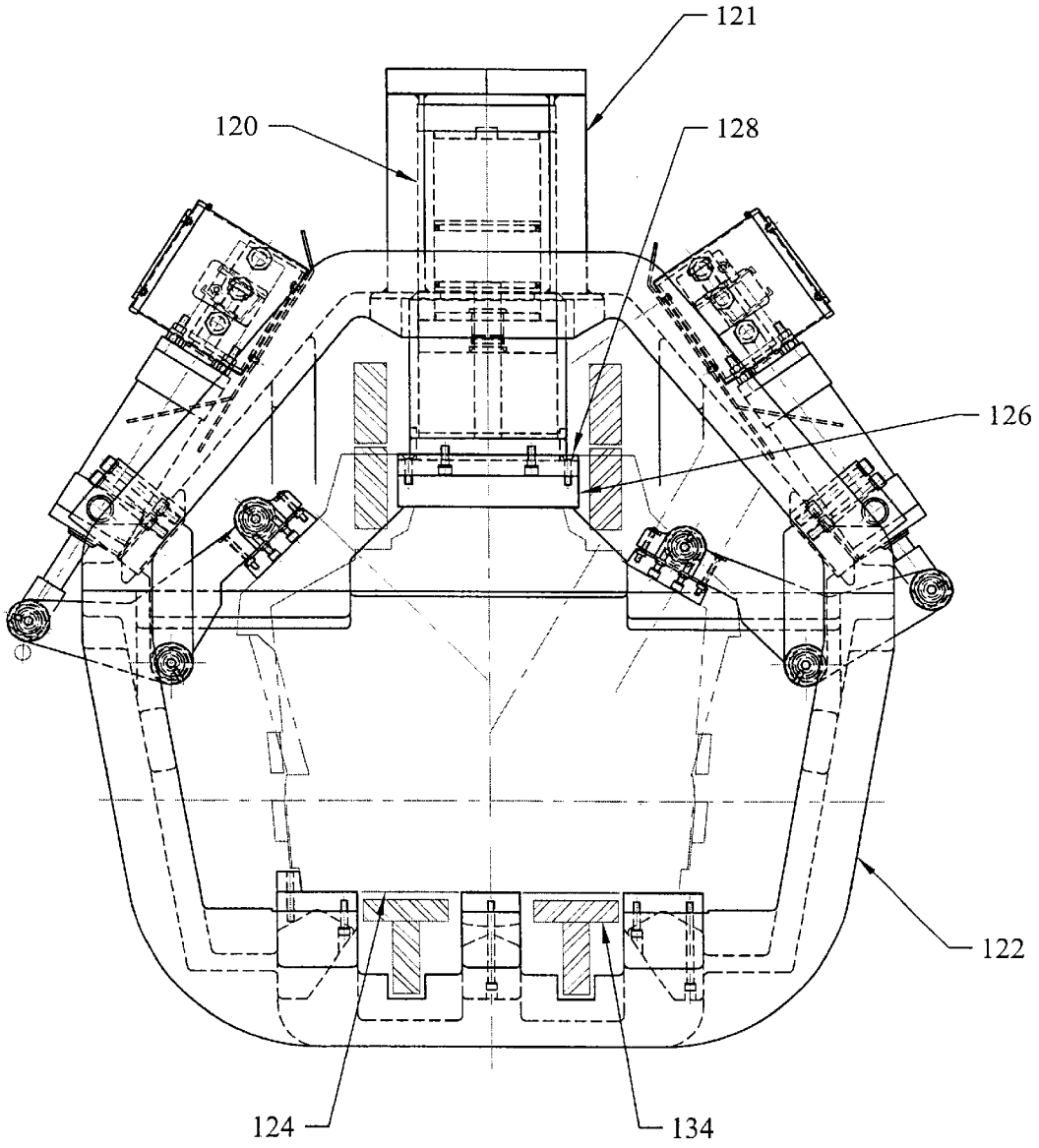
FIG. 6 is an end elevational view of a cage used in the casting rollover apparatus according to the present invention.
Figure 7:
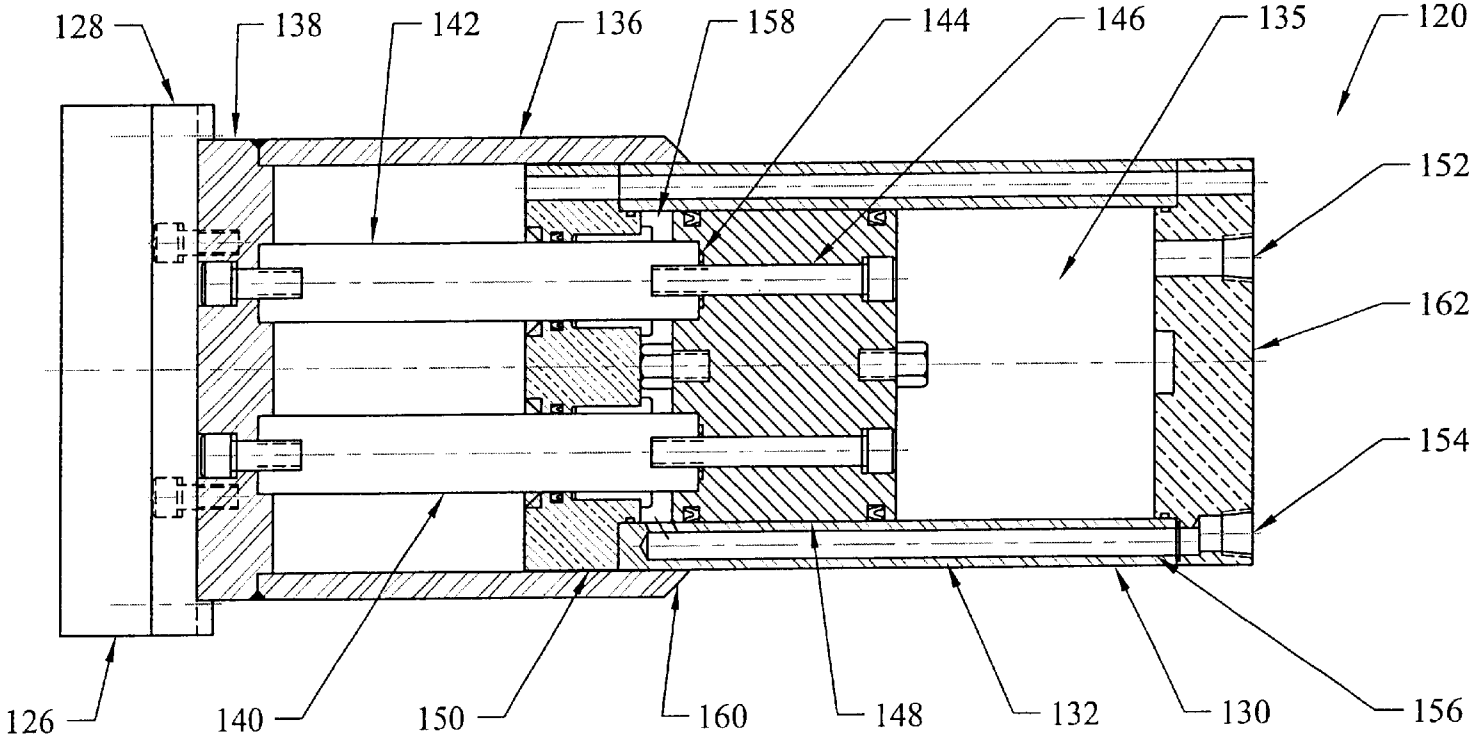
FIG. 7 is a longitudinal, cross-sectional view of the clamp cylinder shown in FIG. 6.

Referring now to FIGS. 6 and 7, there is depicted a unique pressurized fluid/or air operated cylinder 120 which is used in the cage 122 to operate a clamp fixture used to hold the mold core 124 in the cage 122. As shown in FIG. 6, the cylinder 120 is mounted in the top portion of the cage 122 by a bracket or mount 121 and has an end plate 162. The end plate 162 is fixed to the bracket or mount 121 on the cage 122.

Figure 1:
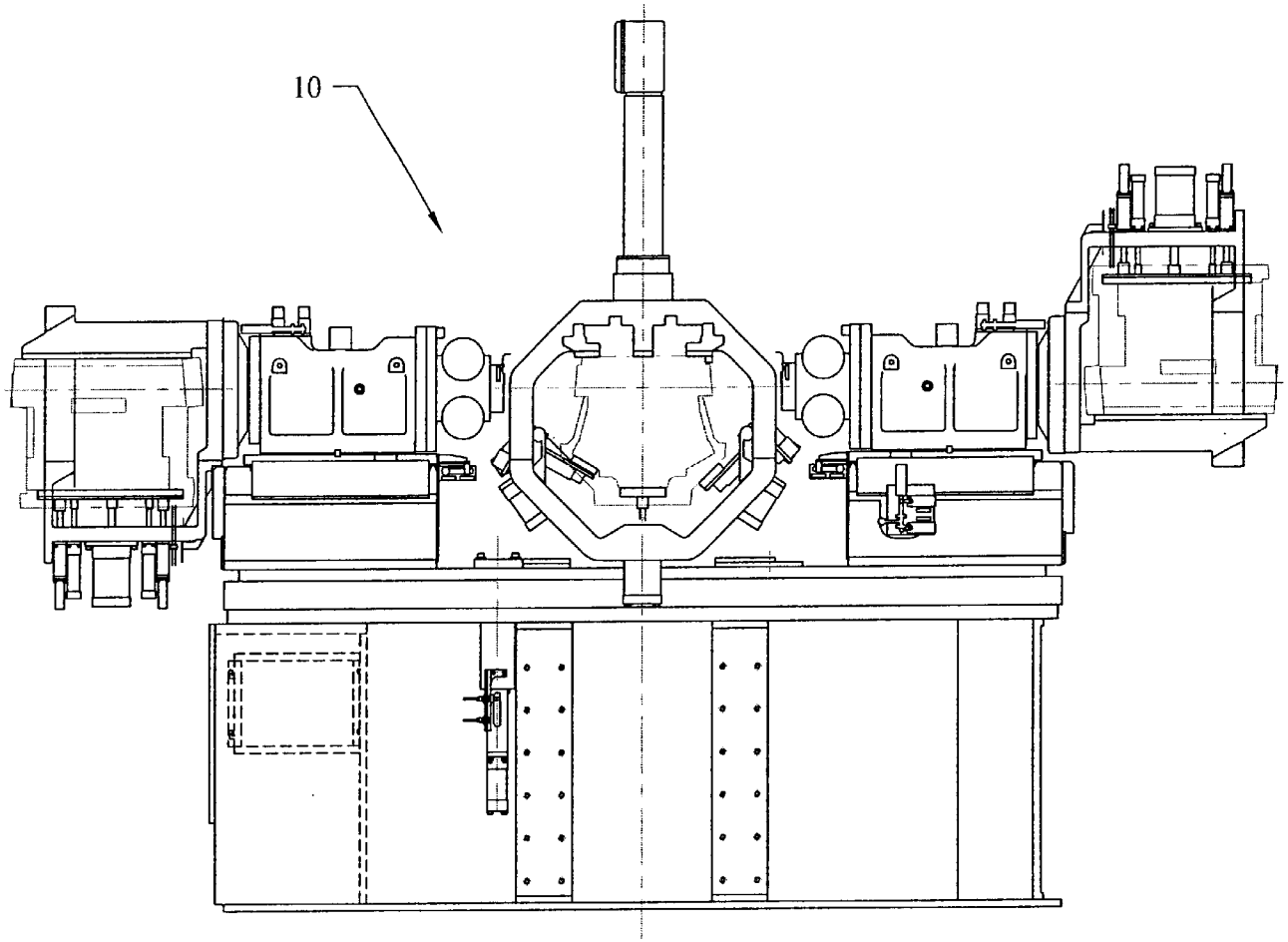
FIG. 1 PRIOR ART
FIG. 1 is a side elevational view of a prior art casting rollover apparatus.

As shown in FIG. 6, the cage 122 is formed of a framework of tubular members carrying a base 134 at a lower end. The mold core 124 is mounted on the base 134 at a load station and is removed from the base 134 at an unload station on the rotary table shown in FIG. 1.

When a new mold core 124 is loaded in to the cage, the clamp cylinder 120 is activated causing movement of a piston 148 to either an extended or a retracted position.

The cylinder piston head 130 is formed of a tubular member having a sidewall 132 and a hollow internal chamber 135 which is closed at one end by the end cap 162. The opposite end of the sidewall 132 is concentrically disposed within a movable tubular housing 136 having an inner diameter slightly larger than the outer diameter of the piston sidewall 132. The tubular member 136 is closed at an opposite end by an end cap 138. A clamp plate 128 is attached to the end cap 138 and causes an RF transmitter 128 which generates mold fill signals.

The clamp cylinder employed in the prior casting rollover apparatus employed a more conventional cylinder having an extensible and retractable rod projecting from one axial end of the cylinder housing. The rod was prone, however, to the deposit of casting material which could interfere with the smooth extension and retraction of the piston rod from the cylinder and lead to a gradual breakdown of the cylinder seals.

One unique feature of the cylinder 120 is a plurality of guide rods 140 and 142 which are fixed at one end by means of fasteners, such as screws, to the end plate 138 and extend through the tubular member 136 to a sealed connection via o-ring 144 and a countersunk threaded bolt 146 in the piston 148. A spacer 150 is fixedly mounted in the tubular member 136, with the guide rods 140 and 142 sliding therethrough in spaced bores.

The cylinder 120 uniquely has end porting in which the advance and return pressurized air connection ports 152 and 154, respectively, are uniquely mounted in the end plate 162 rather than on the side of the cylinder as in Assignee's prior clamp cylinder or as is conventional in air operated cylinders. This arrangement places the air connections further away from the molten metal in the mold core as well as enabling the sidewalls 132 of the piston head 130 to remain smooth, for reasons which will become more apparent hereafter.

As shown in FIG. 7, the advance port 152 communicates with the interior chamber 135 in the piston head 130. The return port 154 extends through an elongated bore 156 through the piston head 130 to a second chamber 158 disposed between the spacer 150 and the piston 148.

In operation, pressurized air applied to the chamber 135 through the advance direction port 152, while the return port 154 is open to exhaust, applies force against one surface of the piston 148 to move the piston 148 and the tubular member 136 in a direction away from the stationary end cap 162 to the fully advanced position shown in FIG. 7.

When it is desired to unclamp the mold, the advance port 152 is connected, typically by valves, not shown, to exhaust and pressurized air is applied to the return port 154. The bore 156 communicates the pressurized air to the chamber 158 whereby causing force to be generated on the opposite surface of the piston 148 resulting in sliding movement of the piston 148 to the right in the orientation shown in FIG. 7 until the tubular member 136 reaches a return position which spaces the clamp plate 128 further away from the mold core to allow loading and unloading of the mold core 124 to and from the cage 122.

During the extension or retraction movement of the piston 148 relative to the piston head 130, it can be seen that the end 160 of the tubular member 136 which is disposed in proximity with the outer surface of the sidewall 132 of the piston head 130 has a sharply pointed end which acts as a scraper to remove any debris, solidified molten metal, etc., from the exterior surface of the sidewall 132 of the piston head 130 thereby assuring smooth, sliding movement of the tubular member 136 relative to the piston head 130. This scraping action defines a unique feature of the cylinder 120 and is possible due to the end porting of the advance and return ports 152 and 154 on the end plate 162 rather than porting along the sides of the cylinder 120 as would be typical in pressurized fluid cylinder designs.

The cylinder 120 also has a modular design construction in that the cylinder 120 can be provided with any stroke or piston head advance length by merely changing the length of one or both of the sidewalls 136 and 132, and the length of the guide rods 140 and 142.

What is claimed is:

1. A casting rollover apparatus comprising:

a cage adapted for supporting an openable and closable casting mold;

an extensible and retractable slide coupled to the cage for moving the cage and the casting mold into and out of engagement with a molten metal discharge nozzle;

first and second pressurized fluid operable cylinders coupled to extend and retract the slide, and a single transducer mounted on one of the first and second cylinders for detecting the position of the slide;

a spindle carried on the slide and coupled to the cage for rotating the cage; and a clamp cylinder carried on the cage for clamping the mold in a closed position.

2. The casting rollover apparatus of claim 1 further comprising:

plug-in connectors for electrically connecting the transducer and cylinder control elements.

3. A casting rollover apparatus comprising:

a cage adapted for supporting an openable and closable casting mold;

an extensible and retractable slide coupled to the cage for moving the cage and the casting mold into and out of engagement with a molten metal discharge nozzle;

a spindle carried on the slide and coupled to the cage for rotating the cage;

a spindle housing surrounding the spindle;

an end cap mounted on one end of the spindle housing; and thrust bearings mounted between the spindle housing and the end cap; and a clamp cylinder carried on the cage for clamping the mold in a closed position.

4. The casting rollover apparatus of claim 3 wherein:

the thrust bearings apply a pre-load force on the spindle.

5. A casting rollover apparatus comprising:

a cage adapted for supporting an openable and closable casting mold;

an extensible and retractable slide coupled to the cage for moving the cage and the casting mold into and out of engagement with a molten metal discharge nozzle;

a spindle carried on the slide and coupled to the cage for rotating the cage;

means including a shaft, coupled to the spindle, for rotating the spindle;

at least one pressurized fluid cylinder coupled to the rotating to drive the rotating means; and a digital proportional valve coupled to the cylinder and receiving a variable electric current from a controller to smoothly decelerate rotation of the shaft; and a clamp cylinder carried on the cage for clamping the mold in a closed position.

6. The casting rollover apparatus of claim 5 further comprising:

an end-of-travel detector cooperating with the spindle to generate an output signal indicating the end of rotational travel of the spindle in one direction; and at least one deceleration-initiating sensor spaced angularly from the end-of-travel detector, the deceleration-initiating sensor generating an output to a controller to initiate decleration of the spindle.

7. A casting rollover apparatus comprising:

a cage adapted for supporting err openable and closable casting mold;

an extensible and retractable slide coupled to the cage for moving the cage and the casting mold into and out of engagement with a molten metal discharge nozzle;

a spindle carried on the slide and coupled to the cage for rotating the cage; and a clamp cylinder carried on the cage for clamping the mold in a closed position, the clamp cylinder including:

a cylinder housing having a sidewall;

a piston disposed in the cylinder housing and movable between first and second positions in response to the input and exhaust of pressurized fluid into the cylinder housing on opposite sides of the piston; and input and exhaust ports carried on an end of the cylinder housing for connecting the input and exhaust of pressurized fluid into the cylinder housing.

8. The casting rollover apparatus of claim 7 wherein the clamp cylinder further comprises:

a tubular member having a sidewall and an end plate;

guide rods coupled between the piston and the end plate on the tubular member; and a spacer coupled to the tubular member and having through bores slideably receiving the guide members therethrough.

9. The casting rollover apparatus of claim 7 wherein the clamp cylinder further comprises:

a tubular member enclosing one end of the cylinder housing, the tubular member coupled to and movable with the piston; and an end of the tubular member concentrically disposed over the sidewall of the cylinder to define a scraping surface with respect to the sidewall of the cylinder housing.

* * * * *

UNITED STATES PATENT AND TRADEMARK OFFICE

CERTIFICATE OF CORRECTION

PATENT NO. : 6,609,555 B2
DATED : August 26, 2003
INVENTOR(S) : Spengler

It is certified that error appears in the above-identified patent and that said Letters Patent is hereby corrected as shown below:

Title page,
Item [*] Notice, delete the phrase "by 84 days" and insert -- by 89 days --

Signed and Sealed this

Thirty-first Day of May, 2005

JON W. DUDAS
*Director of the United States Patent and Trademark Office*